US008375993B2

(12) United States Patent
Esche et al.

(10) Patent No.: US 8,375,993 B2
(45) Date of Patent: Feb. 19, 2013

(54) CORROSION RESISTANT FAUCETS WITH COMPONENTS MADE OF DIFFERENT METALLIC MATERIALS

(75) Inventors: John C. Esche, Kohler, WI (US); Steven T. Radder, Kiel, WI (US)

(73) Assignee: Kohler Co., Kohler, WI (US)

( * ) Notice: Subject to any disclaimer, the term of this patent is extended or adjusted under 35 U.S.C. 154(b) by 356 days.

(21) Appl. No.: 12/647,665

(22) Filed: Dec. 28, 2009

(65) Prior Publication Data

US 2010/0282349 A1 Nov. 11, 2010

Related U.S. Application Data

(60) Provisional application No. 61/176,516, filed on May 8, 2009.

(51) Int. Cl.
*F16K 21/00* (2006.01)
*E03C 1/04* (2006.01)

(52) U.S. Cl. ..... 137/801; 4/677

(58) Field of Classification Search ..... 137/801, 137/625.4, 625.41, 625.17; 4/675–678, 695
See application file for complete search history.

(56) References Cited

U.S. PATENT DOCUMENTS

| | | | | |
|---|---|---|---|---|
| 4,325,403 | A * | 4/1982 | Uhlmann | 137/315.11 |
| 4,606,372 | A * | 8/1986 | Hayman | 137/315.13 |
| 4,733,688 | A * | 3/1988 | Lorch | 137/454.6 |
| 5,417,242 | A * | 5/1995 | Goncze | 137/625.17 |
| 5,575,424 | A | 11/1996 | Fleischmann | |
| 5,755,258 | A * | 5/1998 | Pawelzik et al. | 137/454.6 |
| 5,937,892 | A * | 8/1999 | Meisner et al. | 137/375 |
| 5,983,939 | A | 11/1999 | Heimann et al. | |
| 6,070,614 | A | 6/2000 | Holzheimer et al. | |
| 6,079,447 | A | 6/2000 | Holzheimer et al. | |
| 6,409,148 | B1 | 6/2002 | Dempsey et al. | |
| 6,757,921 | B2 | 7/2004 | Esche | |
| 7,533,683 | B2 * | 5/2009 | Ortega et al. | 137/15.18 |
| 2006/0118185 | A1 * | 6/2006 | Nobili | 137/625.41 |
| 2007/0256744 | A1 | 11/2007 | Leutwyler et al. | |

FOREIGN PATENT DOCUMENTS

| | | |
|---|---|---|
| EP | 1046846 | 10/2000 |
| EP | 2108748 | 10/2009 |
| WO | WO 2004/007854 | 1/2004 |

OTHER PUBLICATIONS

Dictionary definition of "collar" from Yahoo Education (http://education.yahoo.com/reference/dictionary/entry/collar) Sep. 27, 2012. See definition 5.*

13 pages of an PCT search report dated Jul. 14, 2010 in the corresponding PCT US2010/033679 application.

* cited by examiner

*Primary Examiner* — Craig Schneider
*Assistant Examiner* — David Colon Morales
(74) *Attorney, Agent, or Firm* — Foley & Lardner LLP

(57) ABSTRACT

A faucet is disclosed which has an outer housing formed of zinc which has a lower entry, an upper outlet, and a side cavity. There is a supply line structure extendible from the lower entry into or adjacent the side cavity, and a valve cartridge positioned in the side cavity. A plastic insulator sleeve is positioned in the side cavity between a wall of the outer housing and the valve cartridge. A brass collar is nested within the insulator sleeve and positioned outside of the valve cartridge. Hence, the advantages of a zinc outer housing are achieved while avoiding galvanic corrosion due to contact between brass and zinc surfaces. The insulator sleeve also facilitates rotational and axial alignment, and sealing.

25 Claims, 3 Drawing Sheets

CORROSION RESISTANT FAUCETS WITH COMPONENTS MADE OF DIFFERENT METALLIC MATERIALS

CROSS-REFERENCE TO RELATED APPLICATION

This application claims priority based on U.S. provisional application 61/176,516 filed May 8, 2009.

STATEMENT OF FEDERALLY SPONSORED RESEARCH OR DEVELOPMENT

Not applicable.

BACKGROUND OF THE INVENTION

The present invention relates to faucets with an outer main housing having a surface made of one metallic composition and at least one adjacent component having a surface made of another metallic composition. More particularly it relates to structures that can avoid galvanic corrosion which could otherwise occur if the two surfaces were in contact with each other after assembly of the faucet.

A typical faucet includes an outer housing made of brass, as well as many internal brass parts. Brass is a preferred material for these purposes due to its appearance, durability, strength, machinability, and ability to support a variety of finishes. However, the material cost of brass can be high, making it desirable to find alternative materials for at least some of the larger faucet parts.

Thus, some lower cost faucets use surface materials that are primarily made of zinc for their outer housing body. However, such zinc-based surfaces are susceptible to corrosion where they contact internal brass components long term. In this regard, when a zinc-based surface is in constant contact with brass, particularly in a wet or humid environment, the differences in electrical properties between the metals can lead to galvanic corrosion.

This can undermine the structural integrity of the housing or alter its decorative appearance. While one could make all internal components of a plastic or even zinc, this would lead to other concerns such as long term reliability and/or strength.

Hence, a need exists for improved faucets which address this problem.

SUMMARY OF THE INVENTION

In one aspect the invention provides a faucet with:

(a) an outer housing having a surface formed of a first material, the outer housing having a lower entry, an upper outlet, and a side cavity;

(b) a supply line structure extendible from the lower entry into or adjacent the side cavity;

(c) a valve cartridge positioned in the side cavity which is suitable to control flow from the supply line structure to the upper outlet if the supply line is supplied with water;

(d) an insulator sleeve positioned at least partly in the side cavity between a wall of the outer housing and the valve cartridge; and (e) a collar having a surface made of a second material different from the first material and at least partly nested within the insulator sleeve outside of the valve cartridge;

(f) wherein the insulator sleeve is made of a material that helps galvanically insulate the outer housing from the collar.

In a preferred embodiment the first and second materials are such that if they were in contact with each other, contacting surfaces of the outer housing and collar could lead to galvanic corrosion of at least one of them. In one embodiment the outer housing is primarily made of zinc, the collar is primarily made of brass, and the insulator sleeve is generally cylindrical and made of plastic.

Further refinements include:

(a) the supply line structure defines a ridge on an exterior surface thereof;

(b) the insulator sleeve defines a ledge on an interior surface and has a resilient clip;

(c) the ridge can be captured between the ledge and the resilient clip to selectively couple the supply line structure to the collar;

(d) the supply line structure includes external threads;

(e) the collar includes internal threads that engage the external threads to couple the collar to the supply member;

(f) there is a groove formed in an exterior surface of the insulator sleeve;

(g) there is an o-ring seated in the groove; and (h) the o-ring can inhibit movement of the insulator sleeve within the outer housing.

In other forms:

(a) the insulator sleeve defines a first key;

(b) the side cavity defines a second key compatible with the first key such that rotation of the insulator sleeve within the outer housing can be restricted thereby;

(c) there is an end cap engaged proximate an end of the side cavity, as well as a valve stem extending from the valve cartridge through the end cap; and (e) a handle is coupled to the valve stem such that the handle controls operation of the valve cartridge.

In still other forms the insulator sleeve defines a lip proximate to a first end of the side cavity, and the collar defines an end face proximate to that first end of the side cavity. When the collar is coupled to the supply line structure, a gap is formed between the lip and the end face such that the collar urges the valve cartridge into engagement with the supply member.

It should be appreciated that the present invention permits the use of a relatively inexpensive outer decorative material for the main faucet housing (such as zinc), while permitting one to continue to use the preferred brass for the collar that traps the valve cartridge. An insulating structure is provided at relatively low additional cost that avoids the galvanic corrosion which would otherwise normally occur if the brass collar were in long term contact with the outer housing.

The insulating sleeve also serves multiple additional valuable purposes, such as rotational and axial alignment, and assisting in the sealing function.

These and still other aspects will be apparent from the detailed description and drawings. What follows is a description of preferred embodiments. However, the claims should be referenced to assess the full scope of the invention.

DETAILED DESCRIPTION OF THE PREFERRED EMBODIMENTS

Figure 1:
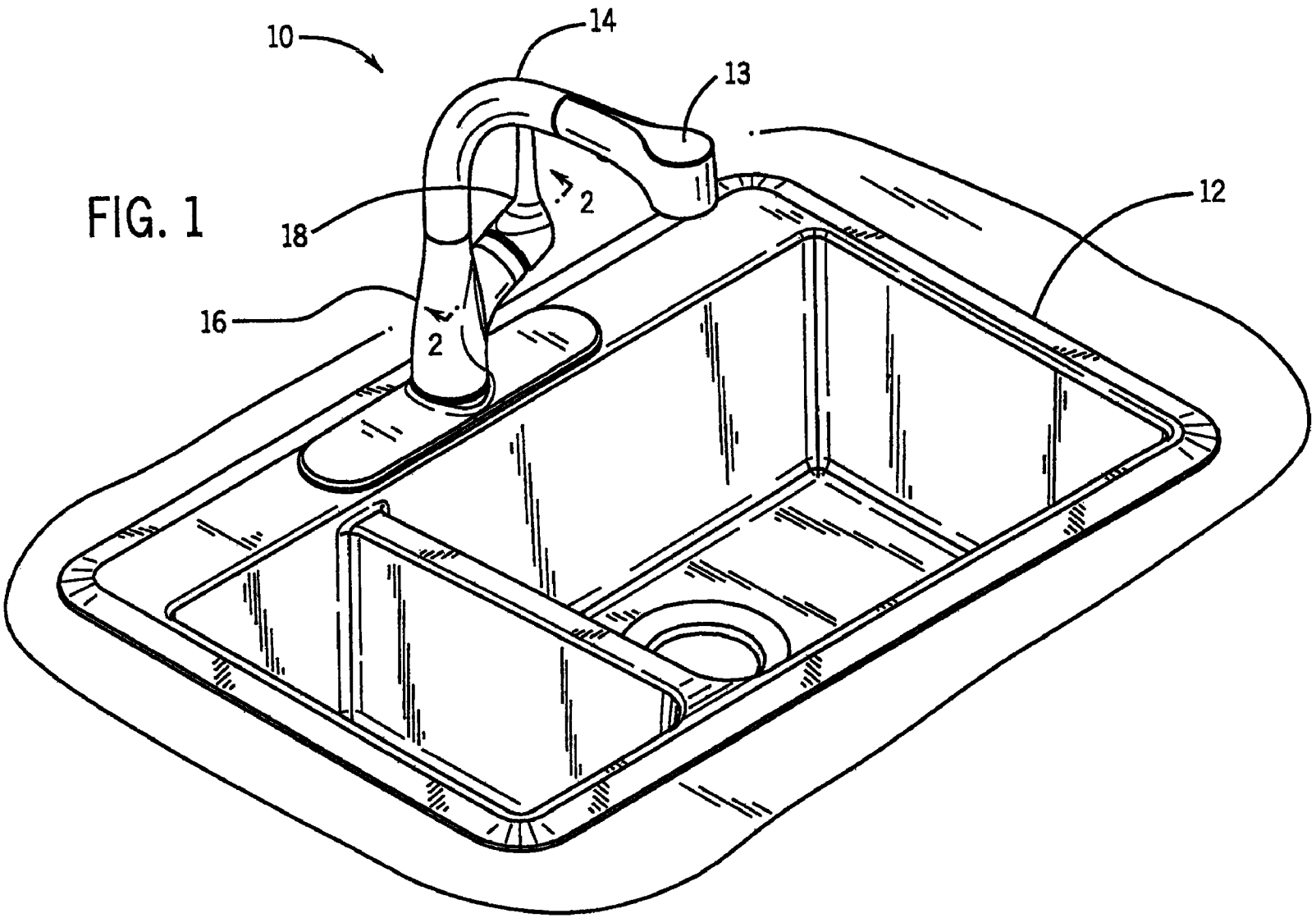
FIG. 1 is an perspective view of a faucet of the present invention which has been mounted on a conventional sink.

An example faucet 10 is shown in FIG. 1 mounted on a conventional kitchen sink 12. It should be appreciated that the term "faucet" is being used in this patent in its broadest sense to cover a wide range of plumbing fittings where water volume and/or temperature is controlled by the fitting adjacent a spout. Thus, it should be interpreted to cover kitchen or bathroom faucets, as well as tub fillers having associated control valving, shower heads having associated control valving, etc.

Faucet 10 is in the form of a kitchen pull-out spray type faucet having a spout 14 extending upward from main outer housing 16. There is a control handle 18 at the side of the faucet to control the flow volume and temperature of water directed out of the outer housing 16 through the spout 14, to an associated pull-out spray head 13.

The outer housing 16 is preferably made of zinc, or a zinc alloy of 50% or more zinc. Alternatively, it could be a base material plated with such a zinc-based formulation. In any event, the outer housing 16 has a lower entry 17, an upper outlet 19, and a side cavity 20. The side cavity includes an inner end 22 and an outer end 24 proximate handle 18.

An insulator sleeve 26 is nested within the side cavity 20. It has a groove 28 formed on an exterior surface 30 in which an o-ring 32 is seated. A mating groove 34 is formed in the outer housing 16 (i.e., within the side cavity 20) such that the o-ring 32 can be seated in both the groove 28 in the insulator sleeve 26 and the groove 34 in the outer housing 16 when the insulator sleeve 26 is nested within the side cavity 20. This helps fix the insulator sleeve 26 in place.

This insulator sleeve 26 is preferably generally cylindrical and made of a non-metallic material, such as plastic (e.g., NORYL brand plastic). One skilled in the art will appreciate, given the benefit of this disclosure, that a variety of other materials may be used provided they inhibit electrochemical communication and thereby reduce galvanic corrosion of various components.

Figure 3:
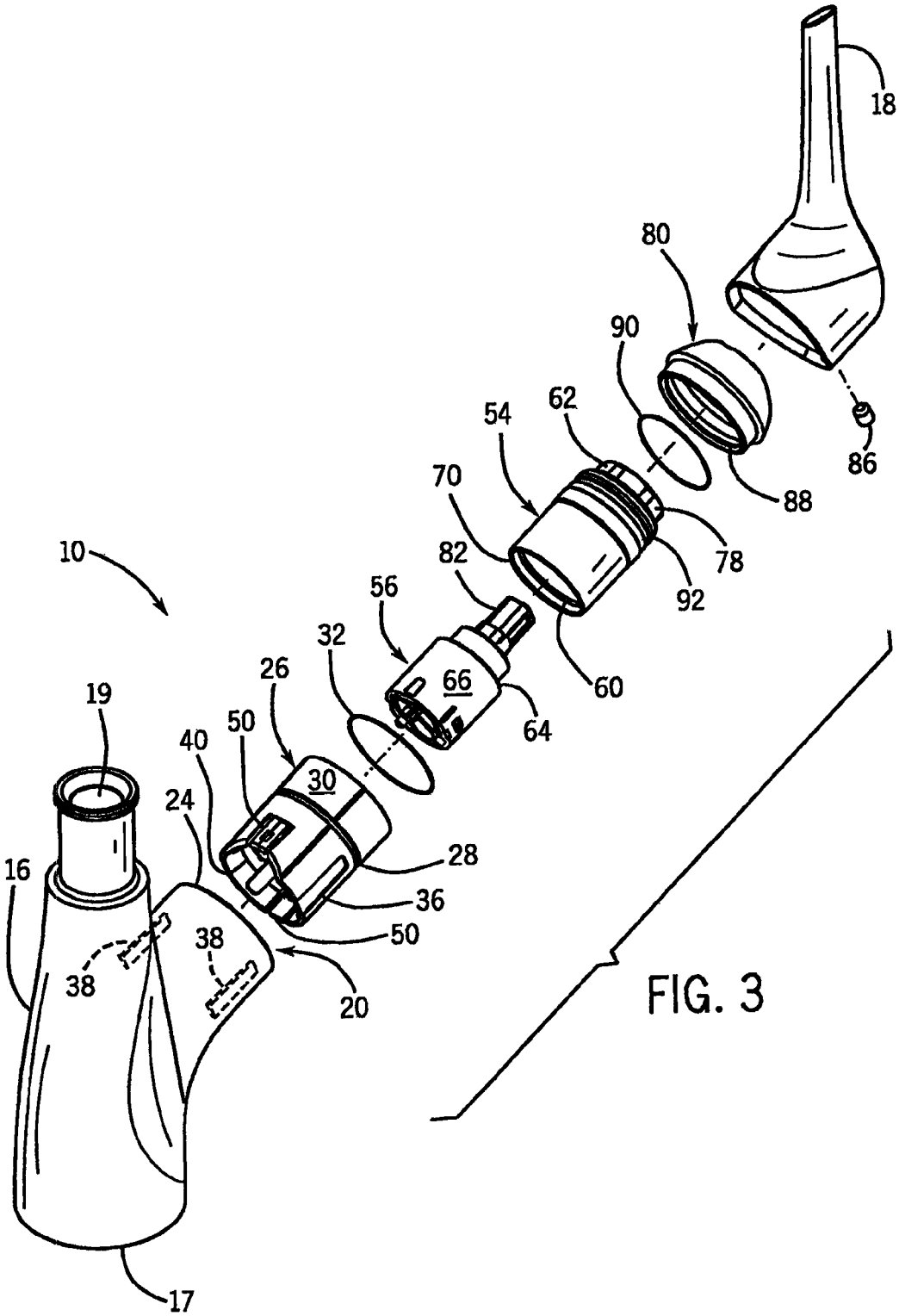
FIG. 3 is an enlarged partial exploded view of portions of the faucet of FIG. 1.

The insulator sleeve 26 can also be keyed to the side cavity 20 such that the orientation of the insulator sleeve 26 within the side cavity 20 can also be rotationally restricted. In this regard the insulator sleeve 26 defines a pair of recesses 36 that are keyed to a pair of protrusions 38 formed within the side cavity 20 (shown best in FIG. 3).

Figure 2:
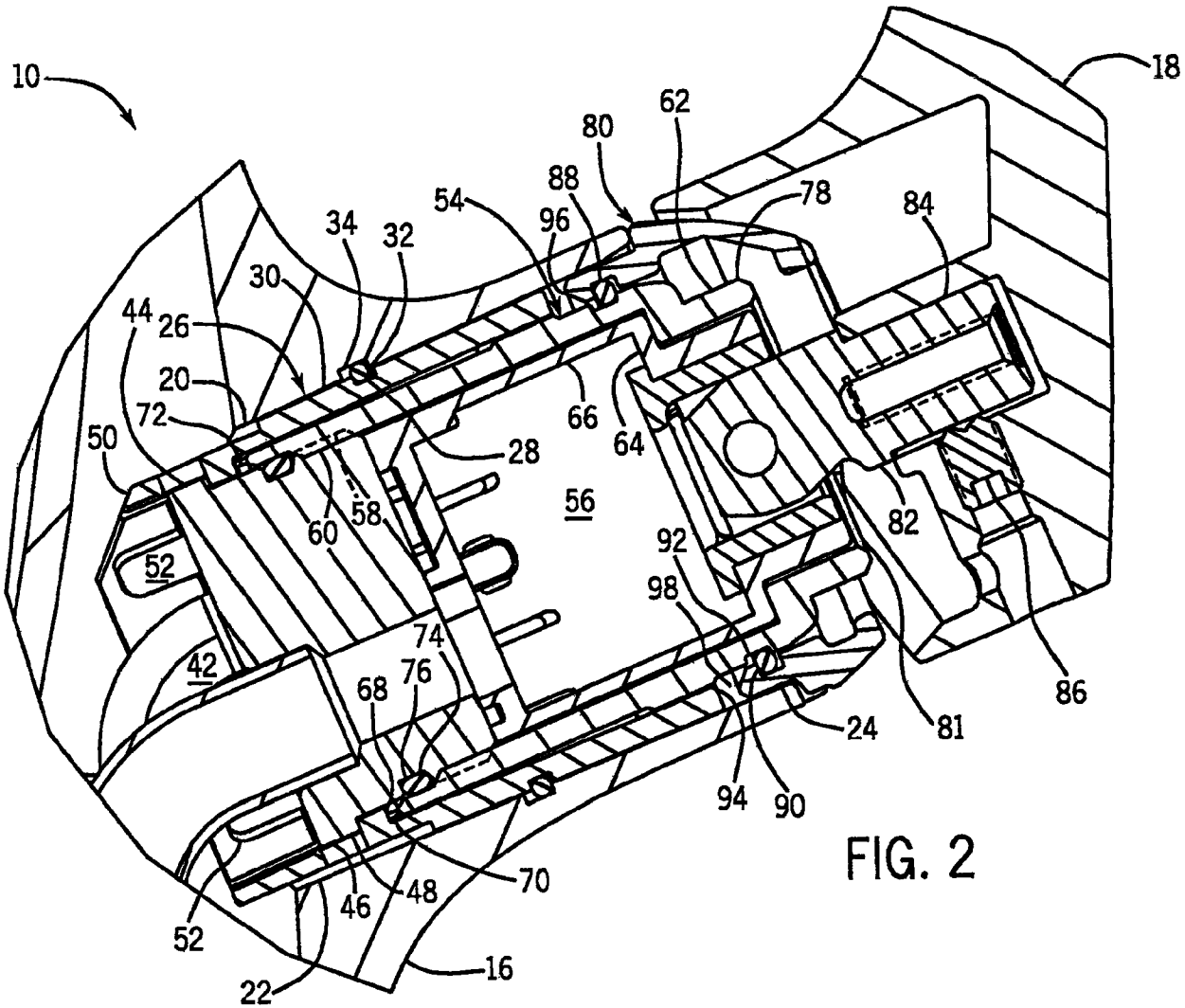
FIG. 2 is a partial section view taken along line 2-2 of FIG. 1.

Moreover, the insulator sleeve 26 may further define a ledge 40 on an interior surface 42. A supply line structure generally 44 (e.g. the water inlet lines, and a "puck" face) has a portion located proximate to the inner end 22 of the side cavity 20 and includes a ridge 46 (shown only in FIG. 2) on an exterior surface 48 which, when assembled in the side cavity 20, engages the ledge 40 of the insulator sleeve 26.

A resilient clip 50 is formed integral with the insulator sleeve 26 and releasably captures the ridge 46 of the supply member 44 between the resilient clip 50 and the ledge 40. Further, a series of alignment fins 52 engage mating alignment grooves (not shown) on the supply line structure 44 to orient the supply line structure 44 within the insulator sleeve 26 (and hence side cavity 20).

With the supply line structure 44 having its terminal end generally located within or adjacent the side cavity 20, a brass collar 54 is nested at least partially within the insulator sleeve 26 to capture a conventional valve cartridge 56, so that an inward end of the valve cartridge abuts a terminal end of the supply line structure 44.

Note that there can also be on the supply line structure 44 external threads 58, and that the brass collar 54 includes mating internal threads 60 that engage the external threads 58 to couple the collar 54 to the supply line structure 44 which may also be brass (therefore capturing the valve cartridge 56). Specifically, a neck 62 of the collar 54 proximate the outer end 24 of the side cavity 20 abuts a shoulder 64 defined by a valve body 66 of the valve cartridge 56.

A close engagement between the valve cartridge 56 and the supply line structure 44 (particularly the puck portion thereof) is desirable. To this end, the insulator sleeve 26 of the example embodiment defines a lip 68 proximate the first inner end 22 of the side cavity 20, and the collar 54 defines an end face 70, also proximate the inner end 22 of the side cavity 20, such that when the collar 54 is coupled to the supply line structure 44, a gap 72 is formed between the lip 68 and the end face 70.

As a result, the collar 54 can be sufficiently tightened to urge the valve cartridge 56 into engagement with the supply line structure 44. An o-ring 74 seated in an annular recess 76 formed in the supply line structure 44 further helps establish a seal between the supply line structure 44 and the collar 54.

As described, the outer housing 16 has an inward surface formed of primarily zinc, and the collar 54 has an adjacent outward surface formed of primarily brass. If they were to be in contact, galvanic corrosion would likely occur during the useful life of the faucet, particularly in a wet or humid environment like this.

However, a plastic or other galvanically insulating sleeve is provided to ensure that these parts are kept apart, yet arranges for a secure and well aligned assembly. Thus, galvanic corrosion is inhibited and the outer housing may be formed of a lower cost material without facing the corrosion concern.

The valve body 66 of the valve cartridge 56 of the example embodiment is preferably made of plastic. With the collar 54 coupled to the supply line structure 44 (e.g., by engaging lands 78 on the neck 62 of the collar 54 with a tool and rotating the collar 54), an end cap 80 is engaged proximate the outer end 24 of the side cavity 20. A valve stem 82 extends from the valve cartridge 56 and through an opening 81 the end cap 80.

The handle 18 which, in the example embodiment, is made of plated or coated zinc (similar to the outer housing 16) includes a cavity 84 for receiving the valve stem 82 and is secured thereto by a set screw 86 oriented transverse to the valve stem 82. As a result, movement of the handle 18 controls operation of the valve cartridge 56 and the resulting flow of water from the faucet 10.

To help secure the end cap 80 proximate the outer housing 16, the end cap 80 defines an internal recess 88 into which an o-ring 90 is seated and the collar 54 includes a mating recess 92 that engages the o-ring 90 when the end cap 80 is engaged into the side cavity 20. To enable the end cap 80 to mount relatively flush to the outer housing 16, a gap 98 is established between an end face 94 of the insulator sleeve 26 (proximate the outer end 24 of the side cavity 20) and an end face 96 of the end cap 80 (proximate the second outer end 24 of the side cavity 20). The end cap 80 of the example embodiment is preferably made of plastic (e.g., acrylonitrile butadiene styrene ("ABS")) and electroplated to provide a robust and aesthetically pleasing appearance.

Preferred example embodiments have been described in considerable detail, including describing the most preferred materials. However, the preferred materials and other aspects of the preferred embodiments are not intended to exemplify the full scope of the claims.

One skilled in the art, given the benefit of this disclosure, will appreciate the variety of other materials capable of use, as well as varied structures to implement these principles. Thus, many modifications and variations of the preferred example embodiments will be apparent to a person of ordinary skill in the art. Therefore, the invention should not be limited to the example embodiments described.

INDUSTRIAL APPLICABILITY

The invention provides faucets having an insulation structure that inhibits galvanic corrosion between two adjacent faucet parts made of dissimilar metals.

What is claimed is:

1. A faucet, comprising:

an outer housing having a surface formed of a first material, the outer housing having a lower entry, an upper outlet, and a side cavity;

a supply line structure extendible from the lower entry into or adjacent the side cavity;

a valve cartridge positioned in the side cavity which is suitable to control flow from the supply line structure to the upper outlet if the supply line is supplied with water;

an insulator sleeve positioned at least partly in the side cavity between a wall of the outer housing and the valve cartridge; and a collar having a surface made of a second material different from the first material and at least partly nested within the insulator sleeve outside of the valve cartridge;

wherein the insulator sleeve is made of a material that helps galvanically insulate the outer housing from the collar wherein the supply line structure defines a ridge on an exterior surface thereof; and wherein the insulator sleeve defines a ledge on an interior surface and has a resilient clip; and whereby the ridge can be captured between the ledge and the resilient clip to selectively couple the supply line structure to the collar.

2. The faucet of claim 1, wherein:

the insulator sleeve defines a first key; and the side cavity defines a second key compatible with the first key such that rotation of the insulator sleeve within the outer housing can be restricted thereby.

3. The faucet of claim 1, wherein:

the insulator sleeve defines a lip proximate to a first end of the side cavity; and the collar defines an end face proximate to the first end of the side cavity;

wherein when the collar is coupled to the supply line structure, a gap is formed between the lip and the end face such that the collar urges the valve cartridge into engagement with the supply line structure.

4. The faucet of claim 1 wherein:

the supply line structure includes external threads; and the collar includes internal threads that engage the external threads to couple the collar to the supply line structure.

5. The faucet of claim 1, further comprising:

a groove formed in an exterior surface of the insulator sleeve; and an o-ring seated in the groove;

wherein the o-ring can inhibit movement of the insulator sleeve within the outer housing.

6. The faucet of claim 1, wherein the surface of the outer housing and surface of the collar are such that if they were in contact with each other this could lead to galvanic corrosion of at least one of them.

7. The faucet of claim 6, wherein the surface of the outer housing is primarily made of zinc, and the surface of the collar is primarily made of brass.

8. The faucet of claim 1, wherein the insulator sleeve is made of plastic.

9. The faucet of claim 8, wherein the insulator sleeve is generally cylindrical.

10. The faucet of claim 1, further comprising an end cap proximate an end of the side cavity and engaged between the outer body and the collar.

11. The faucet of claim 10, further comprising:

a valve stem extending from the valve cartridge through the end cap; and a handle coupled to the valve stem such that the handle controls operation of the valve cartridge.

12. A faucet, comprising:

an outer housing having a surface formed of a first material, the outer housing having a lower entry, an upper outlet, and a side cavity;

a supply line structure extendible from the lower entry into or adjacent the side cavity;

a valve cartridge positioned in the side cavity which is suitable to control flow from the supply line structure to the upper outlet if the supply line is supplied with water;

an insulator sleeve positioned at least partly in the side cavity between a wall of the outer housing and the valve cartridge; and a collar having a surface made of a second material different from the first material and at least partly nested within the insulator sleeve outside of the valve cartridge;

wherein the insulator sleeve is made of a material that helps galvanically insulate the outer housing from the collar;

wherein the insulator sleeve defines a first key; and wherein the side cavity defines a second key compatible with the first key such that rotation of the insulator sleeve within the outer housing can be restricted thereby.

13. The faucet of claim 12, wherein the supply line structure defines a ridge on an exterior surface thereof; and wherein the insulator sleeve defines a ledge on an interior surface and has a resilient clip; and whereby the ridge can be captured between the ledge and the resilient clip to selectively couple the supply line structure to the collar.

14. The faucet of claim 12, wherein:

the supply line structure includes external threads; and the collar includes internal threads that engage the external threads to couple the collar to the supply line structure.

15. The faucet of claim 12, further comprising:

a groove formed in an exterior surface of the insulator sleeve; and an o-ring seated in the groove;

wherein the o-ring can inhibit movement of the insulator sleeve within the outer housing.

16. The faucet of claim 12, wherein the insulator sleeve is generally cylindrical.

17. The faucet of claim 12, wherein the second key comprises a protrusion, and the first key comprises a recess configured to receive the protrusion.

18. The faucet of claim 12, wherein the insulator sleeve is made of plastic.

19. The faucet of claim 12, wherein:

the insulator sleeve defines a lip proximate to a first end of the side cavity; and the collar defines an end face proximate to the first end of the side cavity;

wherein when the collar is coupled to the supply line structure, a gap is formed between the lip and the end face such that the collar urges the valve cartridge into engagement with the supply line structure.

20. The faucet of claim 12, wherein the surface of the outer housing and surface of the collar are such that if they were in contact with each other this could lead to galvanic corrosion of at least one of them.

21. The faucet of claim 20, wherein the surface of the outer housing is primarily made of zinc, and the surface of the collar is primarily made of brass.

22. The faucet of claim 12, further comprising an end cap proximate an end of the side cavity and engaged between the outer body and the collar.

23. The faucet of claim 22, further comprising:

a valve stem extending from the valve cartridge through the end cap; and a handle coupled to the valve stem such that the handle controls operation of the valve cartridge.

24. A faucet, comprising:

an outer housing having a surface formed of a first material, the outer housing having a lower entry, an upper outlet, and a side cavity;

a supply line structure extendible from the lower entry into or adjacent the side cavity;

a valve cartridge positioned in the side cavity which is suitable to control flow from the supply line structure to the upper outlet if the supply line is supplied with water;

an insulator sleeve positioned at least partly in the side cavity between a wall of the outer housing and the valve cartridge; and a collar having a surface made of a second material different from the first material and at least partly nested within the insulator sleeve outside of the valve cartridge;

wherein the insulator sleeve is made of a material that helps galvanically insulate the outer housing from the collar wherein the insulator sleeve defines a lip proximate to a first end of the side cavity;

wherein the collar defines an end face proximate to the first end of the side cavity; and wherein when the collar is coupled to the supply line structure, a gap is formed between the lip and the end face such that the collar urges the valve cartridge into engagement with the supply line structure.

25. The faucet of claim 24, wherein when the valve cartridge engages the supply line structure, there remains a gap between the lip of the insulator sleeve and the end face of the collar.

* * * * *